US006273774B1

(12) United States Patent
Warzecha

(10) Patent No.: US 6,273,774 B1
(45) Date of Patent: Aug. 14, 2001

(54) AQUATIC FLOTATION DEVICE WITH EASY MOUNT AND DISMOUNT

(76) Inventor: Todd Robert Warzecha, 7410 Reed Dr., Volente, TX (US) 78641

( * ) Notice: Subject to any disclaimer, the term of this patent is extended or adjusted under 35 U.S.C. 154(b) by 0 days.

(21) Appl. No.: 09/504,673

(22) Filed: Feb. 15, 2000

(51) Int. Cl.[7] ..... B63C 9/08
(52) U.S. Cl. ..... 441/129; 441/130
(58) Field of Search ..... 441/35, 43, 44, 441/129–130, 132, 136

(56) References Cited

U.S. PATENT DOCUMENTS 1,107,632 * 8/1914 Tabulo ..... 441/44
1,562,276 * 11/1925 Assenzio ..... 441/132
3,097,374 * 7/1963 Browning ..... 441/43

* cited by examiner

*Primary Examiner*—Jesus D. Sotelo
(74) *Attorney, Agent, or Firm*—Rick B. Yeager

(57) ABSTRACT

An improved aquatic flotation device particularly useful for dogs. The preferred embodiment of the device includes a relatively flat rectangular platform supported by two floats located on opposite sides of the platform. Each float is connected by two or more straps to the platform. The device is designed so that it can be thrown from shore or from a boat, and land in a manner that the platform is submerged about 1 to 8 inches without a load, and approximately 2 to 15 inches with a load. When a person or a dog attempts to crawl onto the platform, the platform will tip toward the animal to permit the animal to climb aboard the platform. The platform will then stabilize in a level position. The device thus allows for mounting and dismounting with little or no assistance from an outside source.

31 Claims, 5 Drawing Sheets

AQUATIC FLOTATION DEVICE WITH EASY MOUNT AND DISMOUNT

FIELD OF INVENTION

This invention relates to an aquatic floatation device used to support a load such as a dog. The design of the device facilitates mounting and dismounting with little or no assistance from an outside source.

BACKGROUND

An object of the present invention is to support a load in a swimming pool, pond, or lake. The device is particularly useful for dogs, but is also appropriate for people and for other animals.

Most flotation devices are wearable, graspable or mountable. When the flotation device is intended to support an animal such as a dog, a mountable type of design is often preferable to a wearable or graspable design.

A principal disadvantage of mountable flotation devices is the difficulty of mounting the devices from the water. This difficulty is encountered by people and by animals such as dogs. An object of the present invention is to provide a device that permits easy mounting and dismounting from the device without outside assistance.

The prior art includes aquatic platforms for rescue and recreation.

U.S. Pat No. 5,421,757 issued Jun. 6, 1995, to Donald Basiliere discloses a rescue raft with a buoyant, elongated floor and a pair of parallel air chambers or pontoons on each side with graspable members extending across the floor to facilitate a victim's entry onto the raft. The platform may also serve as a ladder. An object of the present invention is to allow the floor to be submerged slightly under the water and to tilt slightly for easier mounting. The current invention can be mounted equally from either end.

U.S. Pat No. 5,374,211 issued Dec. 20, 1994, to Mitsuo Imazato discloses a lifesaving device including flotation cylinders, where victims may stand on a rope attached to the cylinders. An object of the present invention is to provide a rigid platform supported by flotation means.

U.S. Pat No. 4,019,214 issued Apr. 26, 1977, to Stewart Shaw discloses a floating standing platform supported by a pair of unshaped metal handles. The platform is submerged in a body of water and anchored in place to be used as a lifesaving device for swimmers. Shaw notes that the device could be modified by removing the safety belt and anchor chain to create a free floating platform for the possible rescue of pets from a pool. The present invention is an easily collapsible and transportable device which is more suited to occasional use, as well as being left indefinitely in the water.

U.S. Pat No. 4,662,852 issued May 5, 1987, to Stephen Schneider discloses a floating reclining lounge which can be adjusted in the aquatic environment. The present invention is two floatation or pontoons with a floor which is submerged under water and tilts for easy mounting and dismounting.

Another object of the present invention is to provide a floatation device which is easy to deploy from shore or from a boat.

Another object of the current invention is to provide a floatation device which is light weight, portable and collapsible to provide convenient storage.

Another object of the current invention is to be adjustable to accommodate various size loads.

Another object of the current invention is to be uncomplicated and inexpensive to produce.

In the preferred embodiment, the floatation device is comprised of two elongated buoyant blocks or air chambers. These blocks or air chambers are constructed from closed cell plastic foam such as polyethylene, polyurethane or vinyl. These blocks or air chambers are connected to the parallel sides of a rectangular platform by flexible, adjustable straps. This platform is non-buoyant and will not float without external support, and it has holes to allow for faster submersion and to provide a traction surface for easy mount and dismount by the animal. The platform is constructed from molded plastic, although metal, fiberglass reinforced plastic or a combination of materials may be used. The platform contains molded in hand holes for transport, and its floor is supported by a relatively ridged perimeter frame that has some flexibility.

The connecting devices are preferably composed of a cloth or nylon web strap with a buckle for adjusting strap length. One end of the strap connector is attached to the bottom of the floatation device, preferably at its longitudinal center-line. The other end of strap connector is attached to the platform by looping the strap loosely through slotted hole and threading it back through the adjusting buckle. This attachment provides a means to adjust the distance between platform and floats. Furthermore, the straps function as flexible connectors to allow the floats to be placed against the platform to reduce the size of the raft for easier transportation and storage. In addition, the end of the strap loops through slotted hole in a manner which allows the float to rotate around the platform 360 degrees.

The two floats are elongated buoyant blocks or air chamber which are preferably symmetric and of similar shape but are longer than they are wide. The bottom side of the floats are preferably less buoyant than the top side. This differential is preferably accomplished by creating a groove longitudinally along the bottom of the float material. The groove creates dual protrusions on either side of groove. The protrusions extend the length of the float. The protrusion aids in stabilizing the floats in an upright position. The floats are preferably longer than the side of the platform to which they are attached, this serves to prevent the raft from tipping too far when being mounted and while in use.

The floatation is designed to control the rate and amount of submergibility. The groove allows the raft to initially submerge and tip rapidly and easily for mounting. After mounting, the floats submerge beyond the top of groove. This allows for a reduced rate of submergibility and a greater liquid displacement, which supports the load. The ends of the floats are long enough to extend several inches beyond both the front and back of the platform. This extended float prevents the raft from being overturned as the raft is being mounted. The ends of the floats are preferably angled or slanted about 15 degrees to aid in quick and easy submergibility.

The floatation device may be constructed with rails, connecting straps, anchoring tabs and attachment slots.

SUMMARY

The invention is an improved aquatic flotation device comprised of at least two flotation means or pontoons, which are attached to two parallel sides of a relatively flat and rigid platform. The flotation means are attached by at least one attaching device such as an adjustable strap connecting each pontoon to the platform. The platform is of a design and material that will allow the platform to be non-buoyant when placed in water. The connecting members are configured to allow the platform to be supported in a submerged position ranging from the surface of the water to approximately eight inches below and parallel to the surface of the water. The platform and connecting devices maintain a spacing of the floatation on two parallel sides of the platform forming two openings at the ends of the platform. In the preferred embodiment, the device is designed to submerge in water at different rates—relatively quickly initially when the platform is empty and more slowly once the load is in place on the platform. This varying submergibility is accomplished with the shape, size and mounting of the floats.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
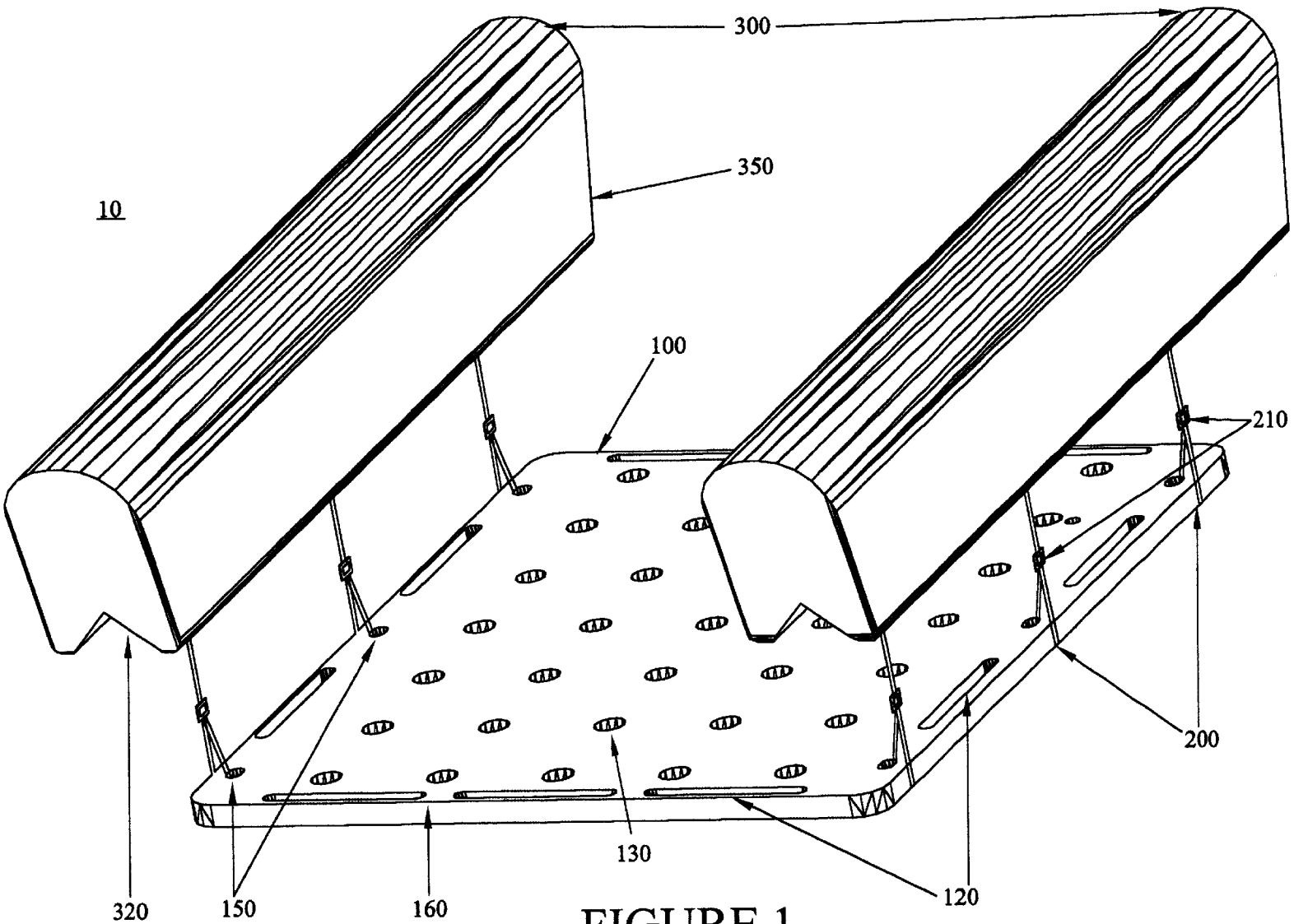
FIG. 1 is a perspective view of the platform, flotation means, and connection means

Referring now to FIG. 1, which is a perspective view of the preferred embodiment of the flotation device 10, the device is comprised of two elongated buoyant blocks or air chambers 300 which are preferably symmetric. The floats 300 are preferably longer than they are wide. The bottom portion of the floats are less buoyant than the top. Preferably, the construction of the floats will be from a closed plastic cell, or foam such as polyethylene, polyurethane, vinyl, or other foam material. The floats are connected to parallel sides of a rectangular platform 100 by flexible, adjustable, strap connectors 200. The platform 100 is constructed of a non-buoyant material, so that when it is placed in water, it does not float with out external support. The platform 100 is perforated with holes 130, having a preferred diameter of approximately 0.5 inch. The holes allow for faster submersion of the platform, and supply a traction surface on the platform to assist in mounting the device. A preferred material for the platform is an injection molded plastic, although metal, fiberglass reinforced plastic, or a combination of suitable materials may be used. A plurality of hand holds 120 are integral to the platform to permit carrying the device.

A connection means such as cloth or nylon web straps 200 are used to support the platform. An adjustable buckle 210 is preferably used as means of adjusting the length of the connection means and the depth of the empty platform. The connector straps are perferably identically perforated to permit the straps to be adjustable in equal increments in order to keep the platform level. One end of each strap connector is attached to the bottom of a float 300 near the longitudinal center line of the float 300. The other end of strap connector is attached to the platform, The preferred platform connection method is to loop each strap loosely through a slotted hole 150 in the platform, and thread it back through the adjusting buckle 210. The buckle may then be used to adjust the distance between platform 100 and the floats 300. The straps also function as hinge or flexible connectors to allow the floats to be placed against the platform to reduce the size of the raft for easier transportation and storage. When the strap is looped through a platform slot, the float is permitted to rotate around the platform so that the device may be thrown into the water without regard to the position of the floats—the platform will be supported whether it lands face up or face down.

The floats 300 are preferably symmetric and are preferably longer than they are wide. The bottom portion of a float is made relatively less buoyant than the top side by preferable creating a groove 320 longitudinally along the bottom of the float material so that the bottom portion of the float contains less flotation material than the top portion. Other means such as tapering the floats may be used to achieve this differential flotation. In one embodiment, the differential buoyancy between the top and bottom of the float is achieved by providing floats that resemble a large dog biscuit when the floats are stacked bottom edge to bottom edge for packaging the device.

Figure 2:
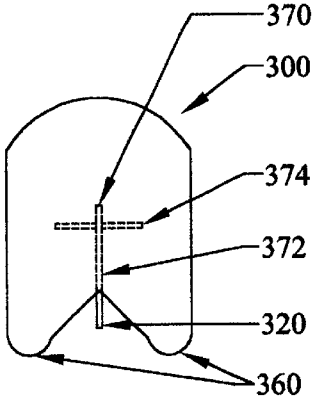
FIG. 2 is an end view of the flotation means.

Referring now to FIG. 2, which is an end view of the preferred flotation means, the groove 320 creates duel protrusions 360 on either side of groove. The protrusions 360 extend for the length of the float 300. The protrusions aid in stabilizing the floats 300 in an upright position. The floats 300 are preferably longer than the side of the platform to which they are attached. Extending the floats 300 beyond the ends of the platform 100 serves to prevent the raft from tipping to far when being mounted or while in use.

The floatation means 300 are designed to control the rate and amount of submergence of the platform. This control is accomplished by the groove, which allows the raft to initially submerge and tip rapidly and easily for mounting. After mounting, the floats submerge beyond the top of groove 320 allowing for a reduced rate of submergibility and a greater water displacement which supports the load. The ends of the float are long enough to extend several inches beyond both ends of the platform. This extended float prevents the raft from being overturned as the raft is being mounted. The ends of the floats 350 are preferably angled approximately 15 degrees to aid in smoothing the submergence.

Figure 3:
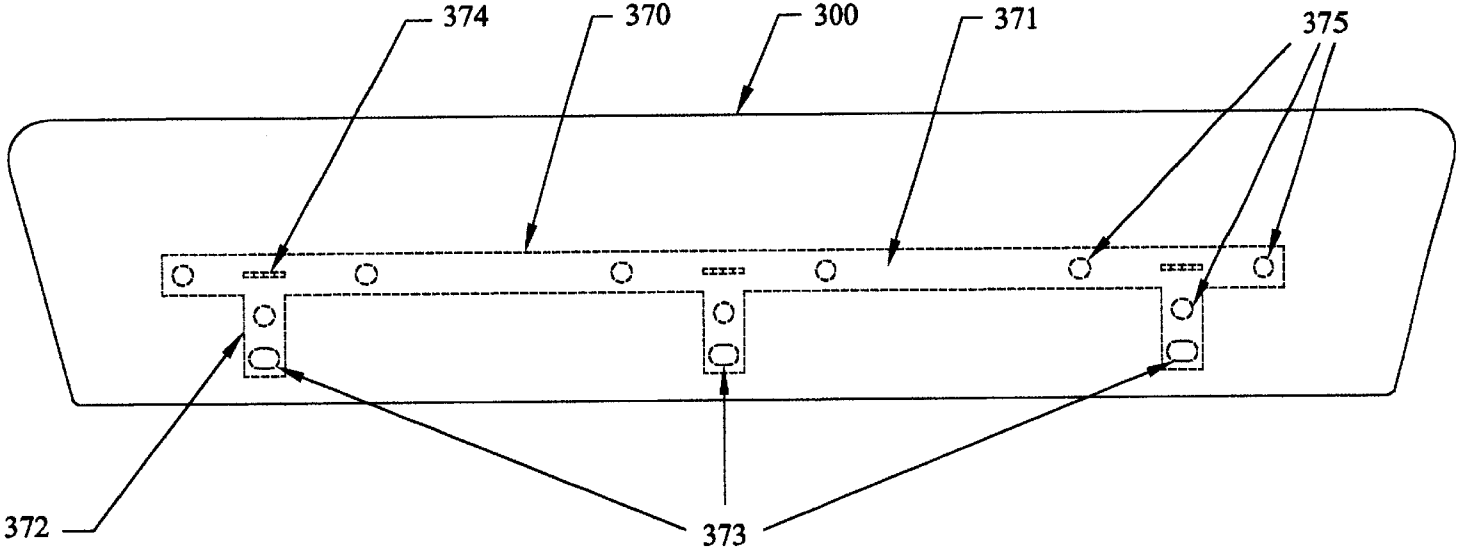
FIG. 3 is a side view of the flotation means and detail of embedded member.
Figure 4:
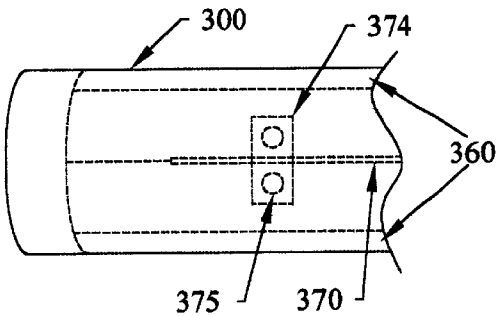
FIG. 4 is a top view of the flotation means.
Figure 5:
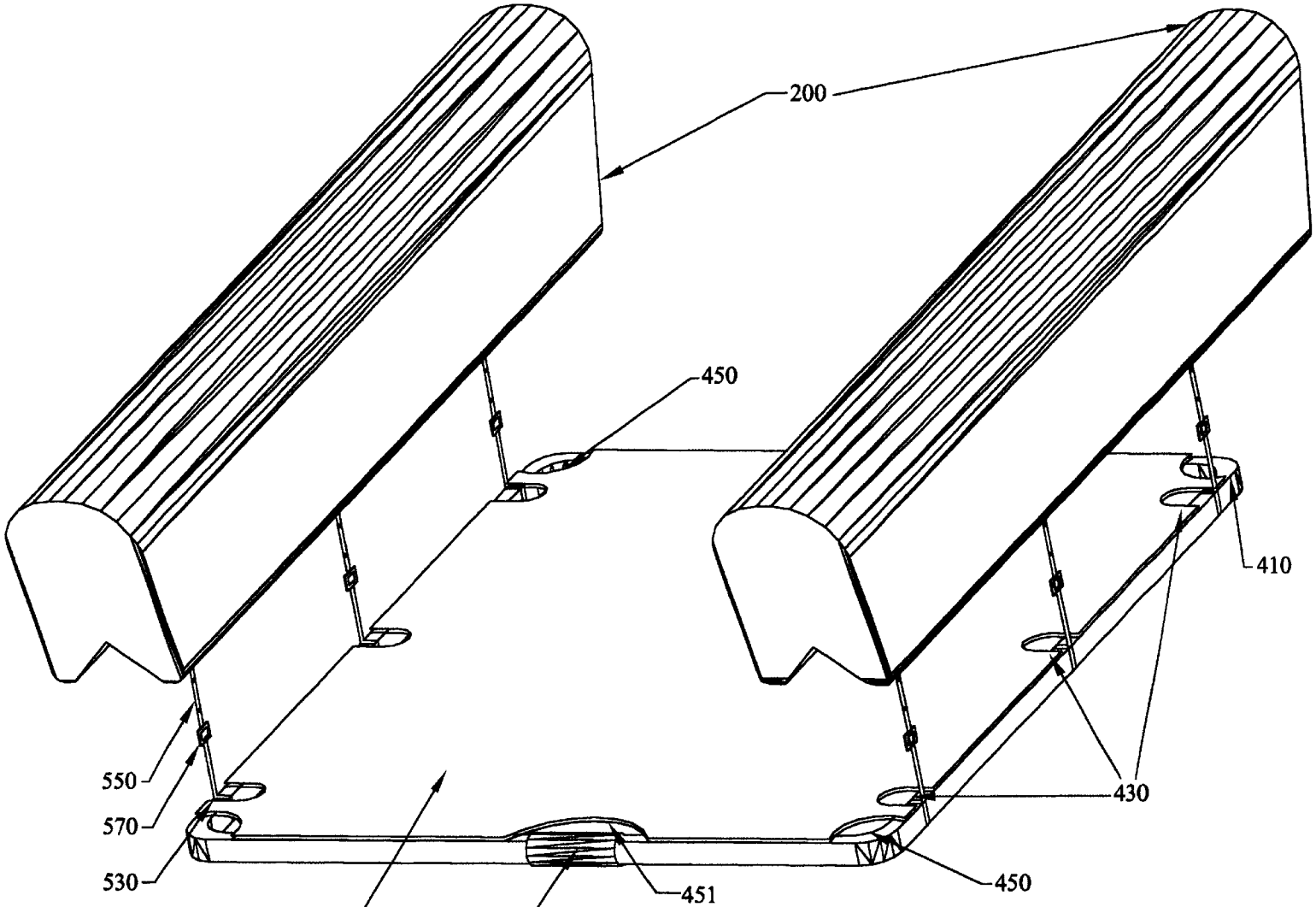
FIG. 5 is perspective view of the platform, flotation means, and connection means for a second embodiment featuring a foldable platform.

Referring to FIG. 3, FIG. 4 and FIG. 5, the floats are preferably fabricated from a closed cell foam flotation material. Preferably, the floats are molded with an embedded insert 370. The insert may be of an injection molded plastic. The insert includes a rail 371, and arms 372 perpendicular to the rail. There is an arm for each connecting strap, and each arm preferably extends into a groove on the float. Anchoring tabs 374 are provided for each arm. Attachment slots 373 are provided at the free end of arms 372. The anchor arms are orientated to project from approximately the center line on the bottom side of the floats to allow each connecting strap 200 to thread through a slot 373. The anchor tabs 374 are included to prevent the embedded insert 370 from being loosened or removed from its embedded position in the float. Perforations 375 are included in the anchoring tabs, arms, and rails to allow the float material to form through the embedded insert 370, thereby improving the attachment or anchoring strength of the insert 370 inside the float 300.

The preferred embodiment, which is suitable for medium to large dogs has a platform approximately 28 inches long, 24 inches wide, and ½ to ¾ inches thick. The corresponding float size is approximately 36 inches long, 7 inches high, and 4.5 inches thick.

In the following explanation, reference is made to a dog as user. The user may also be a human adult, child, or infant, disabled or not, or other animal. Any of these users would mount the raft in a similar manner. The mounting procedure is found to be a series of natural movements.

The raft is deployed by placing it or throwing it onto a body of water. The design of the raft allows it to automatically assume the desired position. The platform will typically sink a few inches below the water surface, and will be held at the proper depth by the floats and the straps. The preferred platform design has two open ends so that the user may approach the raft from either end.

Because of the submerged position of the platform, the dog is able to easily place a front paw on the end of the platform closest to it. As the dog forces its weight on the platform, the end of the platform closest to the dog begins to submerge as the floats support part of the weight of the dog. As the dog moves forward in mounting the platform, the platform travels toward and under the dog.

As the dog continues to travel forward, the raft end submerges further and supports more of the dog's weight. As the end of the raft closest to the dog submerges, the end of the floats submerge and move under the dog at a downward angle with respect to the surface of the water. This additional submergence allows the dog to place it's hind legs on the platform, thereby allowing the dog to propel itself forward and up the platform. As the dog moves forward, it continues to pull the raft back under itself.

As the dog brings himself to the center of the raft, the raft is brought back to a stable position approximately parallel to the surface of the water. The backward motion of the raft diminishes.

When the dog has completely mounted the raft the platform, the raft will automatically stabilize. The raft platform will remain relatively parallel to the water surface. The raft platform will submerge several inches under the dog's weight with the floats submerging proportionally. The raft is then at rest, and so is the dog. The dog is free to move about the platform area. Dogs will typically sit or stand on the platform. Although the raft will tip slightly as the dog moves or adjusts its position, the raft will not roll over and will remain stabile enough for the dog to feel secure.

Some dogs may exit the raft in an easy swimming dismount. Some dogs will leap from the raft. In the later case the inherent drag of the raft prevents it from being propelled too rapidly or forcefully in the opposite direction.

ALTERNATE EMBODIMENT-PLATFORM FRAME

Referring again to FIG. 1, as an alternative to a very rigid platform, a rigid perimeter frame 160 may be used as a support for the platform floor.

ALTERNATE EMBODIMENT-HINGED SUPPORTS

Figure 6:
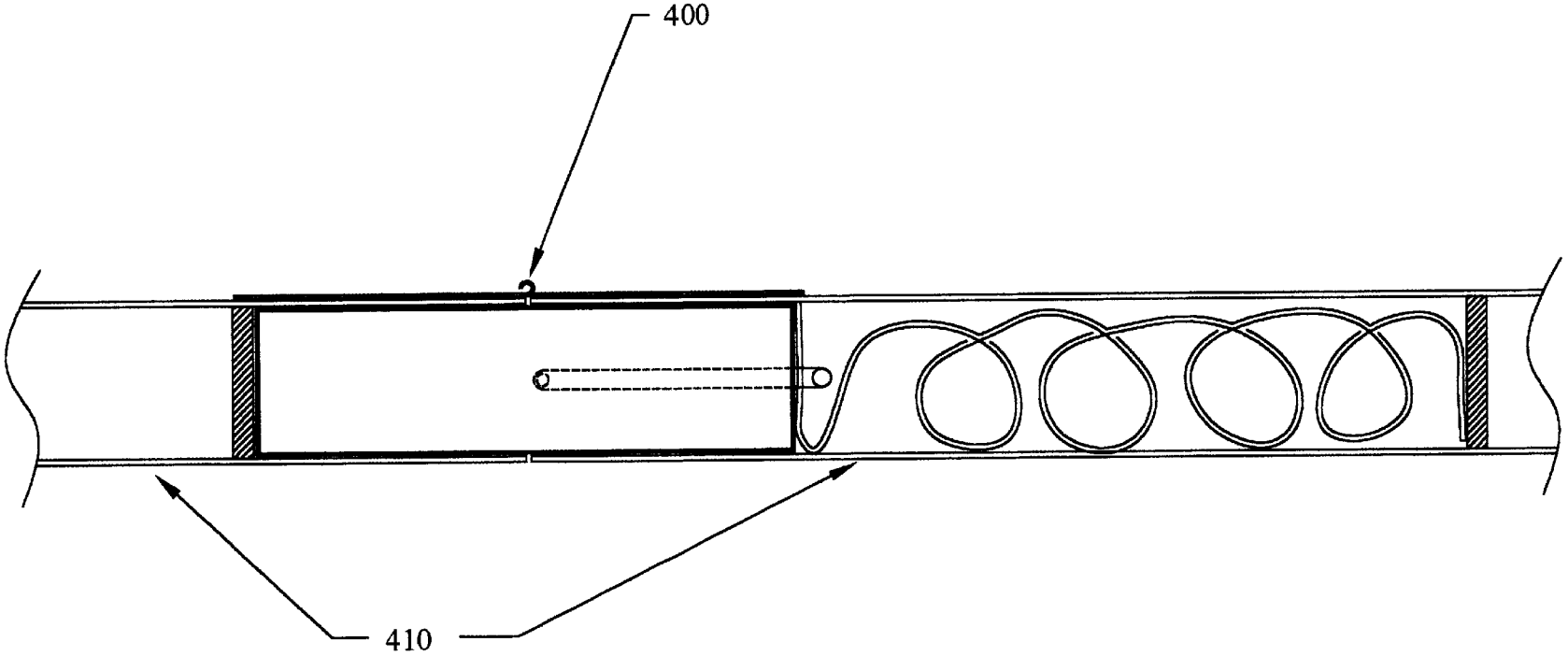
FIG. 6 is a detail of the hinge and latching device.
Figure 7:
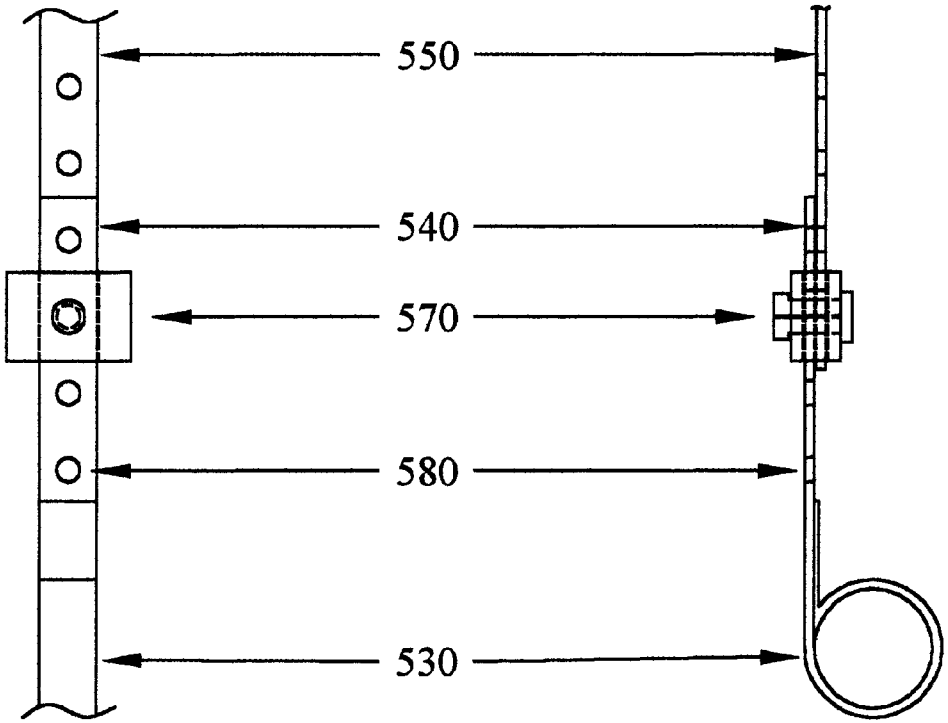
FIG. 7 is a detail of the adjustable, hinged attaching member for the second embodiment.

Referring now to FIG. 5, the figure illustrates an alternate embodiment in which the platform is constructed of a hollow tubular frame. The frame is preferably constructed of a light-weight and non-corroding material such as aluminum or plastic. The frame 410 may be formed by bending two lengths of tubing to form open ended rectangular sections, where each section supports a portion of the platform. The end sections of the frame are joined together by two hinge mechanisms 400 shown in detail in FIG. 6. The hinges allow the frame 410 to be folded in half for transport and storage. A latching device shown in detail in FIG. 7 provides a means to latch the frame 410 in a unfolded or open position and prevents the frame from folding when latched and in use. In this embodiment, a strong fabric 460, such as polyester or vinyl, may form the floor of the raft platform. The fabric 460 is stretched taught over the frame 400 when the raft is in the open and latched position. Cut out sections 451 are provided to prevent the fabric 460 from binding in the hinge and to allow access to the latch. Furthermore, cut outs 451 aid in reliving the tension in the fabric 460 when the platform is being folded. Cut outs 450 at each corner of the fabric 460 are provided to prevent the fabric 460 from bunching in the corners. Another function of the cut outs 450 is to provide handhold in the platform. An additional function of the cutouts 450 is to provide a means for the water to pass through the platform and there by aid in the submersion of the platform. Cut outs 430 in the fabric 460 on each side of the platform allows access to the tubular frame 410 for the attachment of the hinged float adjusters. An additional function of cut outs 430 is to aid in the submersion of the platform.

FIG. 7 shows the float attachment and the hinged adjuster comprised of two perforated adjuster strips 540 and 550, adjuster latching collar 570 and hinging frame attachment 530. These parts 540, 550, 370, 540, 530 may be made from the same injection molded plastic. The perforated adjusting strip 550 is attached to an embedded anchoring means as described in the first embodiment. Each arm may be lengthened to extended several inches (4 to 6 inches) beyond the bottom of float 200 to form strip 550. Equally spaced perforations 580 are provided for the adjustment device. Strip 540 is formed into a loop 530 on one end. Loop 530 is of a diameter which will fit loosely around the frame tube 410 allowing loop 530 to rotate freely around frame tube 410. The strip 540 is perforated with equally spaced holes 580 to match the holes in part 550. Strip 540 and strip 550 are joined as illustrated in FIG. 9 by a movable adjuster 570 which contains a pin that corresponds in size with the perforations in strip 540 and 550.

ALTERNATE EMBODIMENT—RESCUE DEVICE

An alternative embodiment of this invention is useful as a rescue device during flood disasters for large animals such as horses, cattle, or sheep. The raft is comprised of a platform 100 and two bouyant chambers 300 configured as in the first and second embodiments. The platform 100 of the raft is approximately 6 feet wide by 8 feet long. The platform is comprised of a perimeter frame 410 made from steel, aluminum, wood or other suitable material. Attached to the frame to form the floor of the raft is a flat metal sheet such as expanded steel or perforated aluminum. Alternately, a perforated wood or plywood material could also be used. The perforations should be approximately one inch in diameter. The flotation members 300 are inflatable air chambers constructed of a waterproof and air-tight fabric such as rubber coated canvas. The air chambers are in a tear drop shape when viewed from the end with the small end of the tear drop as the bottom side. The air chambers 300 measure approx 10 ½ feet long by 1 foot in diameter. The connecting members are a flexible cord, chain, cable, or nylon web strap 210. In this embodiment a flexible cord or strap is used to secure the air chamber 300 to the attaching member 210. A series of D-rings are secured to the lowest portion of float.

Through the D-ring is secured one end of a strap connector. The other end of the strap is secured to the platform perimeter frame. The length of the strap can be changed to change the distance between the platform and air chambers. This embodiment can be attached to an anchor or moored to a permanent structure allowing the user to remain secure until rescued or until the flood waters recede sufficiently.

All embodiments scan be attached to a boat or structure as an aid in exiting the water.

What is claimed is:

1. A flotation device comprising:

a non-buoyant foldable perforated platform;

a first flotation means;

a plurality of first connection means, such that the first connection means attach at least two points along a first portion of the periphery of the platform to the first flotation means;

a second flotation means, and a plurality of second connection means, such that the second connection means attach at least two points along a first portion of the periphery of the platform to the second flotation means.

2. The flotation device of claim 1 wherein there is at least one hand-hold means integral to the platform.

3. The flotation device of claim 1 wherein a rigid frame is integral to the platform, thereby creating an essentially planar platform.

4. The flotation device of claim 1 wherein when placed in water, the platform is supported by the first flotation means and the second flotation means and a first flexible connection means which attaches a first edge of the platform to the first flotation means, and a second flexible connection means which attaches a second edge of the platform to the second flotation means, such that, with no load, the platform is held approximately parallel to the surface of the water at depth of approximately one to eight inches.

5. The flotation device of claim 1 wherein the first flotation means is longer than the platform; and the second flotation means is longer than the platform.

6. The flotation device of claim 1 wherein the first connection means is flexible; and the second connection means is flexible.

7. The flotation device of claim 6 wherein the first flexible connection means include adjustment means to change the distance between the platform and the first flotation means; and the second flexible connection means include adjustment means to change the distance between the platform and the second flotation means.

8. The flotation device of claim 7 wherein the adjustment means is a buckle.

9. The flotation device of claim 7 wherein the adjustment means is a buckle.

10. The flotation device of claim 9 wherein the first flexible connection means is at least two straps; and the second flexible connection means is at least two straps.

11. The flotation device of claim 9 wherein the first flexible connection means is three straps; and the second flexible connection means is three straps.

12. The flotation device of claim 6 wherein the first flexible connection means is at least two straps; and the second flexible connection means is at least two straps.

13. The flotation device of claim 6 wherein the first flexible connection means is three straps; and the second flexible connection means is three straps.

14. The flotation device of claim 6 wherein the platform is reversible.

15. The flotation device of claim 14 wherein the first flexible connection means is rotatably attached to the platform so that the first flexible connection means may be rotated at least 180 degrees about the platform; and the second flexible connection means is rotatably attached to the platform so that the second flexible connection means may be rotated at least 180 degrees about the platform such that the platform may be supported by the first flotation means and the second flotation means in a face-up position when the platform is placed face-up in water, and may be supported by the first flotation means and the second flotation means in a face-down position when the platform is placed face-down in water.

16. A flotation device comprising:

a non-buoyant perforated platform;

a first flotation means, such that the first flotation means has an upper portion and a lower portion such that the buoyancy of the upper portion is different from the buoyancy of the lower portion;

a plurality of first connection means, such that the first connection means attach at least two points along a first portion of the periphery of the platform to the first flotation means;

a second flotation means, such that the second flotation means has an upper portion and a lower portion such that the buoyancy of the upper portion is different from the buoyancy of the lower portion; and a plurality of second connection means, such that the second connection means attach at least two points along a first portion of the periphery of the platform to the second flotation means.

17. The flotation device of claim 16 wherein the upper portion of the first flotation means has a greater buoyancy than the lower portion of the first flotation means; and the upper portion of the second flotation means has a greater buoyancy than the lower portion of the second flotation means.

18. The flotation device of claim 17 wherein the upper portion of the first flotation means has a greater cross-sectional area than the lower portion of the first flotation means; and the upper portion of the second flotation means has a greater cross-sectional area than the lower portion of the second flotation means.

19. The flotation device of claim 18 wherein there is a notch in the lower portion of the first flotation means; and there is a notch in the lower portion of the second flotation means.

20. The flotation device of claim 17 wherein the upper portions of the first flotation means and second flotation means are longer than the lower portions of the first flotation means and second flotation means.

21. The flotation device of claim 16 wherein the first connection means and the second connection means are flexible and equally adjustable in order to permit the platform to be supported horizontally at various adjustable depths when the device is placed in water.

22. A flotation device comprising:

a rectangular, non-buoyant, perforated platform, the platform having a first edge with a plurality of strap attachment slots, a second edge, a third edge with a plurality of strap attachment slots, and a fourth edge, with at least one of the platform edges containing at least one hand-hold means;

a first float having a first end, a second end, a length greater than the first edge of the platform, an upper portion, and a lower portion such that the upper portion has a greater buoyancy than the lower portion;

a second float having a first end, a second end, a length greater than the third edge of the platform, an upper portion, and a lower portion such that the upper portion has a greater buoyancy than the lower portion;

at least two first float straps attaching the first float to the first edge of the platform, each strap looped through a corresponding first edge attachment slot such that the strap may rotate at least 180 degrees about the first edge, and each strap having an adjustment means to adjust the distance between the first edge and the first float; and at least two second float straps attaching the second float to the third edge of the platform, each strap looped through a corresponding third edge attachment slot such that the strap may rotate at least 180 degrees about the third edge, and each strap having an adjustment means to adjust the distance between the third edge and the second float.

23. The flotation device of claim 22 wherein the strap adjustment means are buckles.

24. The flotation device of claim 22 wherein a third first float strap attaches the first float to the first edge of the platform, the strap looped through a corresponding first edge attachment slot such that the strap may rotate at least 180 degrees about the first edge, and the strap having an adjustment means to adjust the distance between the first edge and the first float; and a third second float strap attaches the second float to the third edge of the platform, the strap looped through a corresponding third edge attachment slot such that the strap may rotate at least 180 degrees about the third edge, and the strap having an adjustment means to adjust the distance between the third edge and the second float.

25. The flotation device of claim 22 wherein the platform is foldable.

26. The flotation device of claim 22 wherein there is a first float notch in the lower portion of the first float from the first end to the second end;

there are a plurality of strap supports embedded in the first float such that a portion of each strap support protrudes into the first float notch, and each first float strap is attached to the protruding portion of a corresponding protruding strap support;

there is a second float notch in the lower portion of the second float from the first end to the second end, and there are a plurality of strap supports embedded in the second float such that a portion of each strap support protrudes into the second float notch, and each second float strap is attached to the protruding portion of a corresponding protruding strap support.

27. The flotation device of claim 22 wherein the first and second ends of the first float and second float are angled approximately 15 degrees so that the upper portions of the first float and second float are longer than the lower portions of the first float and second float.

28. A flotation device comprising:

a non-buoyant perforated platform;

a first flotation means;

a plurality of flexible and adjustable first connection means, such that the first connection means attach at least two points along a first portion of the periphery of the platform to the first flotation means;

a second flotation means, and a plurality of flexible and adjustable second connection means, such that the second connection means attach at least two points along a first portion of the periphery of the platform to the second flotation means, and such that the first connection means and the second connection means are equally adjustable in order to permit the platform to be supported horizontally at various adjustable depths when the device is placed in water.

29. The flotation device of claim 28 wherein when placed in water with no load, the platform is held approximately parallel to the surface of the water at depth of approximately one to eight inches.

30. The flotation device of claim 28 wherein the platform is reversible.

31. The flotation device of claim 30 wherein the first flexible connection means is rotatably attached to the platform so that the first flexible connection means may be rotated at least 180 degrees about the platform; and the second flexible connection means is rotatably attached to the platform so that the second flexible connection means may be rotated at least 180 degrees about the platform such that the platform may be supported by the first flotation means and the second flotation means in a face-up position when the platform is placed face-up in water, and may be supported by the first flotation means and the second flotation means in a face-down position when the platform is placed face-down in water.

* * * * *